US005557587A

United States Patent [19]

Tosaka et al.

[11] Patent Number: 5,557,587

[45] Date of Patent: Sep. 17, 1996

[54] CONNECTING STRUCTURE FOR A WRIST WATCH

[75] Inventors: Susumu Tosaka; Junsuke Kashikie, both of Tanashi, Japan

[73] Assignee: Citizen Watch Co., Ltd., Japan

[21] Appl. No.: 363,928

[22] Filed: Dec. 27, 1994

[51] Int. Cl.[6] ..... G04B 37/16; A44C 5/00

[52] U.S. Cl. ..... 368/282; 224/164

[58] Field of Search ..... 368/281–282; 24/265 R, 265 WS; 224/164, 167, 168, 170, 171, 177, 180

[56] References Cited

U.S. PATENT DOCUMENTS

| | | | |
|---|---|---|---|
| 2,948,941 | 8/1960 | Bruhn et al. | 368/282 |
| 3,964,250 | 6/1976 | Manchester | 368/282 |
| 4,414,719 | 11/1983 | Cadolupo | 24/265 WS |
| 4,837,901 | 6/1989 | Bert | 24/265 B |
| 5,197,046 | 3/1993 | Siu | 368/282 |

FOREIGN PATENT DOCUMENTS

| | | |
|---|---|---|
| 332267 | 12/1993 | Japan . |
| 321082 | 12/1994 | Japan . |

*Primary Examiner*—Vit W. Miska

*Attorney, Agent, or Firm*—Dennison, Meserole, Pollack & Scheiner

[57] ABSTRACT

A slit pipe which is compressible in a radial direction thereof is attached to a watch case between a pair of leg portions. A groove is formed in a link of a watch band so as to be engaged with the slit pipe. The groove has an opening formed on the underside of the link, an introducing portion communicating with the opening, a groove portion formed at an innermost end of the groove. The opening has a width smaller than an outer diameter of the pipe, and larger than an outer diameter of the pipe when compressed. The groove portion has an inner diameter larger than the outer diameter of the pipe. Thus, the pipe may be inserted in the groove portion from the opening passing through the introducing portion.

12 Claims, 7 Drawing Sheets

CONNECTING STRUCTURE FOR A WRIST WATCH

BACKGROUND OF THE INVENTION

The present invention relates to a connecting structure for a wrist watch for connecting a watch case to a watch band and for connecting links of a watch band.

Recently, a wrist watch has a high fashionable characteristic with various designs. A wrist watch having a dial and a band which are capable of changing with another one by a user has been sold. It is enjoyable to the user to change designs of the dial and the band of the watch by himself.

In case of a metallic watch band, the length of the band is adjusted by a dealer or a user using a tool such as a pair of tweezers.

FIG. 17 shows a conventional connecting structure for a wrist watch for connecting a watch band to a watch case using a spring-loaded pin. A watch band 32 has a connecting link 33 connected to an end of the band. A connecting bar 34 having a pair of spring-loaded retractable pins at opposite ends thereof is mounted in the connecting link 33. Both pins are engaged with connecting holes 31*a* formed in a pair of leg portions provided on a watch case 31. Thus, the watch band 32 is connected to the watch case 31.

FIG. 18 shows a conventional connecting structure for connecting links of a watch band using a hairpin-shaped connecting pin. In the structure, links 35 and 36 are connected with a hairpin-shaped connecting pin 37. In order to adjust the length of the band, a bifurcated end of the hairpin-shaped connecting pin 37 is pushed by a push rod 38 in the lateral direction of the band and a bent end of the pin is projected to the opposite side of the link 36. The projected end of the pin 37 is gripped by a pair of tweezers 39 to pull out the pin. Thus, the links 35 and 36 are disconnected. If the links 35, 36, and the pin 37 are not accurately processed, a comparatively large force is required for the disconnecting operation of the links.

In the connecting structure of FIG. 17, in the connecting and disconnecting operations of the watch case 31 and the band 32, it is necessary to use a tool such as a pair of tweezers for engaging the spring-loaded connecting bar 34 with the connecting holes 31*a* of the case, and for disengaging the bar from the holes. Since such operations require skilled work, the band 32 can not be easily changed to another band by the user.

In the connecting structure of FIG. 18, it is necessary to use the push rod 38 and the tweezers 39, and a considerable magnitude of force for engaging and disengaging the hairpin-shaped connecting pin 37. Thus, it is very troublesome and difficult for the dealer and the user to adjust the length of the band.

SUMMARY OF THE INVENTION

An object of the present invention is to provide a connecting structure for a wrist watch for connecting a watch case to a watch band and for connecting links of a watch band where connecting and disconnecting operations of the watch case and the watch band and links of the watch band are easily operated.

According to the present invention, there is provided a connecting structure for connecting a member of a wrist watch to another member of the wrist watch, comprising a pipe which is compressible in a radial direction thereof and attached to one of the members, positioned in a lateral direction with respect to a longitudinal direction of a band of the wrist watch, a groove formed in the other member in the lateral direction so as to be engaged with the pipe.

The groove has an opening formed on the underside of the member, an introducing portion communicating with the opening, a groove portion having an approximately circular section and formed at an innermost end of the groove. Each of the opening and introducing portion has a width smaller than an outer diameter of the pipe, and larger than an outer diameter of the pipe when compressed, and the groove portion has an inner diameter larger than the outer diameter of the pipe. Thus, the pipe may be inserted in the groove portion from the opening passing through the introducing portion.

One of the members is a watch case and the other members is a link of the band.

Both the members may be links of the band, respectively.

These and other objects and features of the present invention will become more apparent from the following detailed description with reference to the accompanying drawings.

DETAILED DESCRIPTION OF THE PREFERRED EMBODIMENTS

Figure 1:
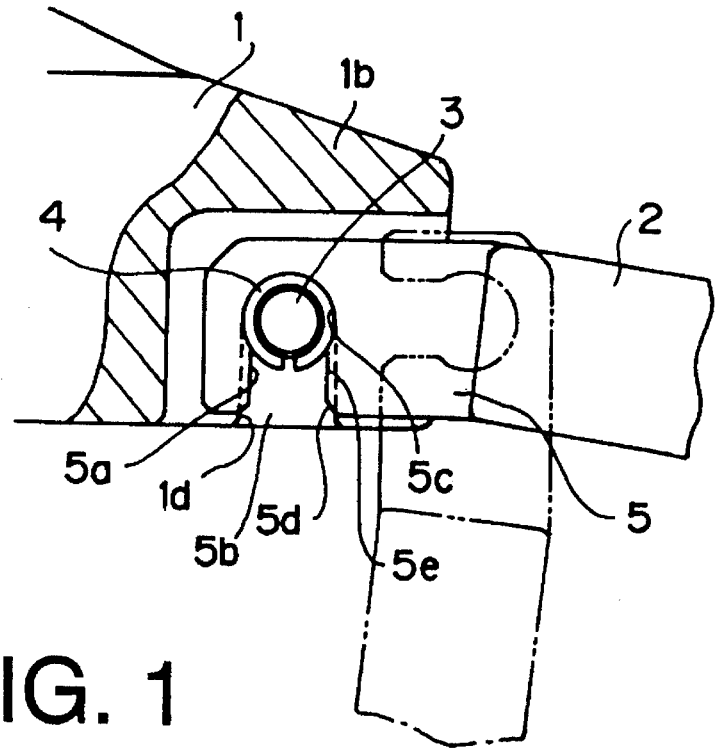
FIG. 1 is a sectional side view showing a connecting structure of a watch case and a watch band according the present invention.
Figure 2:
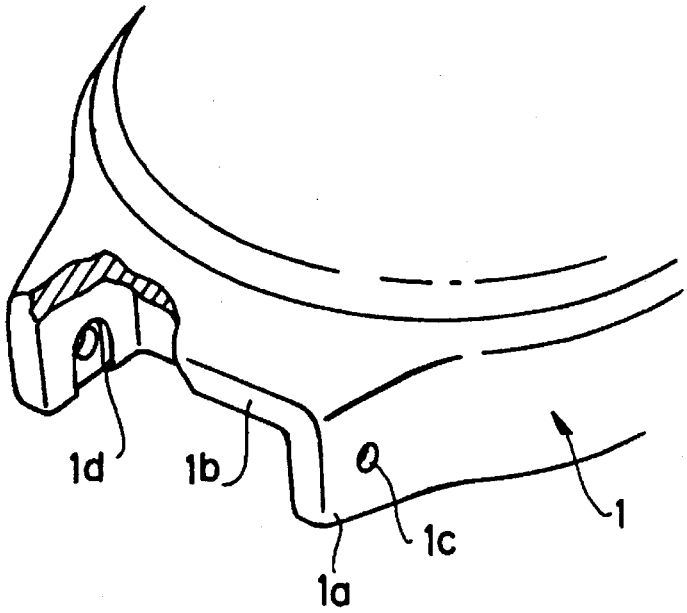
FIG. 2 is a perspective view showing a part of the watch case of FIG. 1.

Referring to FIGS. 1 and 2 showing a connecting structure for a wrist watch to which the present invention is applied as a first embodiment, a watch case 1 comprises a pair of leg portions 1*a* and an overhang cover portion 1*b* provided between the leg portions 1*a*. Each of the leg portion la has a hole 1*c* and a U-shaped groove 1*d* formed in an inside wall thereof in the vertical direction corresponding to the hole 1*c*. The U-shaped groove 1*d* has a width larger than the diameter of the hole 1*c* and an inner end circular portion concentric with the hole 1*c*. Both ends of a compressible slit pipe 4 is engaged with the inner periphery of the groove 1*d*. A connecting pin 3 is inserted into the holes 1*c* and the slit pipe 4 and secured to the holes 1*c* by brazing.

Figure 3:
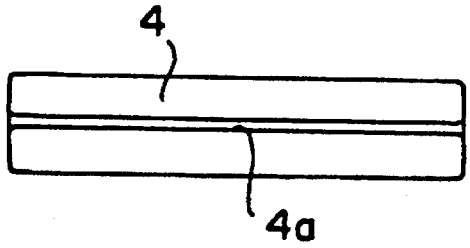
FIG. 3 is a plan view showing a slit pipe.

As shown in FIG. 3, the slit pipe 4 is formed in a cylindrical shape made of a resilient metal plate. The slit pipe 4 has an axial slit 4*a* so as to be compressed in the radial direction. The inner diameter of the slit pipe is larger than the diameter of the pin 3 by a predetermined value.

A watch band 2 has a connecting link 5 connected to the watch case 1. The connecting link 5 has a groove 5*a* formed in the lateral direction of the band. The groove 5*a* has an opening 5*b* opened at the underside of the connecting link, an introducing portion 5*e* communicated with the opening 5*b*, and an inner groove 5*c* at an innermost end having an approximately circular shape in section. Guide portions 5*d* are formed on opposite edges of the opening 5*b* to be outwardly inclined.

The diameter of the inner groove 5*c* is larger than the widths of the opening 5*b* and the introducing portion 5*e*. The width of the opening 5*b* is smaller than an outer diameter of the slit pipe 4. The width of the opening 5*b* is larger than an outer diameter of the slit pipe 4 when the slit pipe is compressed in the radial direction. The diameter of the inner groove 5*c* is larger than the outer diameter of the slit pipe 4.

In order to connect the band 2 to the case 1, the case 1 is gripped by a hand of the user, and the band 2 is gripped by the other hand. The band 2 is positioned at a right angle about the case 1 as shown by a dot-dash line of FIG. 1. The groove 5*a* of the connecting link 5 is engaged with the slit pipe 4 mounted on the pin 3 and the connecting link 5 is pushed in the radial direction of the slit pipe. Since the inner diameter of the slit pipe 4 is larger than the diameter of the pin 3 to provide a gap therebetween, the slit pipe 4 is compressed in the radial direction. Since the width of the opening 5*b* of the groove 5*a* is larger than the outer diameter of the compressed slit pipe 4, the slit pipe 4 passes the opening 5*b* and reaches the inner groove 5*c* passing through the introducing portion 5*e*. Since the diameter of the inner groove 5*c* is larger than the outer diameter of the slit pipe 4, the diameter of the slit pipe is returned to the original size by its resiliency. The connecting link 5 engages with the pin 3 through the slit pipe 4 so that the band 2 is connected to the case 1.

In a connected state, since the slit pipe 4 is rotatably engaged with the groove 1*d* of the watch case 1 and the gap is provided between the slit pipe 4 and the pin 3, the band 2 is rotatably engaged with the case 1 about the pin 3.

In order to disengage the band 2 from the case 1, the band 2 is positioned at a right angle about the case 1 and the band 2 is pulled out from the slit pipe 4 with force. Namely, the slit pipe 4 engaged in the inner groove 5*c* is abutted on the opening 5*b* to be compressed so as to pass the opening 5*b*. Thus, the connecting link 5 is removed from the slit pipe 4.

In accordance with the present invention, connecting and disconnecting operations of the case 1 and the band 2 are easily operated without using a tool.

In the first embodiment, the slit pipe 4 is engaged with the groove 1*d* of the case 1 and the overhang cover portion 1*b* is provided on the case. Thus, the slit pipe is prevented from removing. Furthermore, the slit pipe is mounted on the pin 3, thereby preventing the slit pipe from crashing.

In the embodiment, although the pin 3 is secured to the watch case 1 and the groove 5*a* is formed in the connecting link 5 of the band 2, both means can be formed in a reverse relation. Namely, the slit pipe 4 and the pin 3 are mounted on the connecting link 5 and the groove 5*a* is formed on the case 1.

Figure 4:
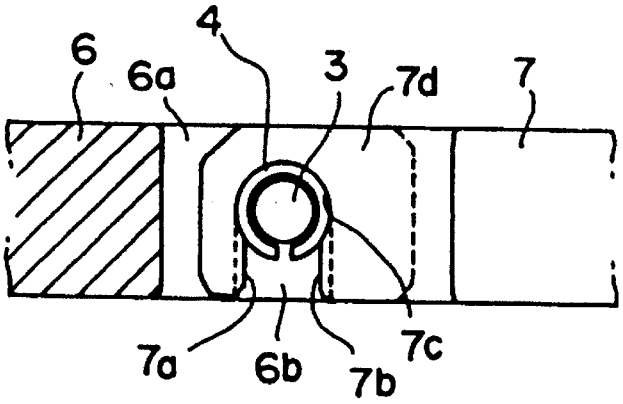
FIG. 4 is a sectional side view showing a connecting structure of a watch band of a second embodiment.

FIG. 4 shows a second embodiment of the present invention. In the embodiment, the connecting structure of the watch case 1 and the watch band 2 of the fist embodiment is applied to a connecting structure of links 6 and 7 of the band 2.

Figure 5:
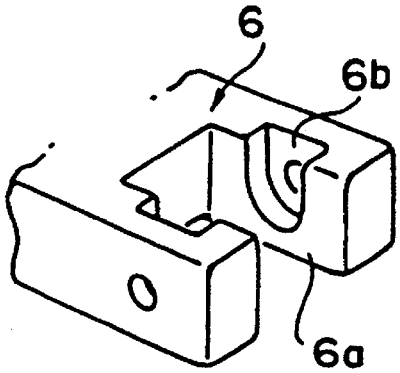
FIG. 5 is a perspective view showing a connecting link of the band.
Figure 6:
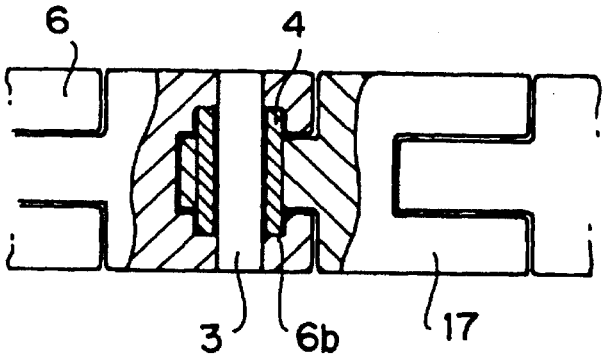
FIG. 6 is a sectional plan view showing the connecting structure of FIG. 4.

As shown in FIG. 5, the link 6 has a notch 6*a* formed on a rear portion in the longitudinal direction of the band. A U-shaped groove 6*b* which has the same structure as the groove 1*d* of the first embodiment is formed on opposite inside walls of the notch 6*a*. The slit pipe 4 is engaged with the grooves 6*b*, the pin 3 is inserted into the slit pipe, and both ends of the pin 3 are secured to the link 6, in the same manners as the first embodiment.

The link 7 has a projection 7*d* engaged with the notch 6*a* and a groove 7*a* formed in the projection 7*d* at the underside thereof. The groove 7*a* has an opening 7*b*, and an inner groove 7*c* having an approximately circular shape in section. Similarly to the first embodiment, the diameter of the inner groove 7*c* is larger than the width of the opening 5*b*. The width of the opening 7*b* is smaller than the outer diameter of the slit pipe 4 and larger than that when the slit pipe is compressed in the radial direction. The diameter of the inner groove 7*c* is larger than the outer diameter of the slit pipe 4.

The methods for connecting and disconnecting the links 6 and 7 are the same as the first embodiment. Thus, the descriptions thereof are omitted.

If the links 6 and 7 are repeatedly engaged and disengaged, the slit 4*a* of the slit pipe 4 is gradually expanded. Accordingly, the slit pipe 4 is liable to be removed from the pin 3. In the embodiment, however, since the slit pipe is engaged with the grooves 6*b*, the slit pipe is not removed from the pin.

The dimension of the slit pipe 4 will be described. As shown in FIG. 3, the slit pipe 4 has the slit 4*a* so that the circumference of the slit pipe is defective in circularness at the slit 4*a*. Consequently, the diameter of the slit pipe at the slit is slightly smaller than the outer diameter thereof. As shown in FIG. 4, when the slit 4*a* is positioned in the downward position, the slit pipe is not removed. However, if the slit 4*a* is positioned in the horizontal position, the link 6 may be removed from the link 7 because of the small diameter of the slit pipe.

Figure 7:
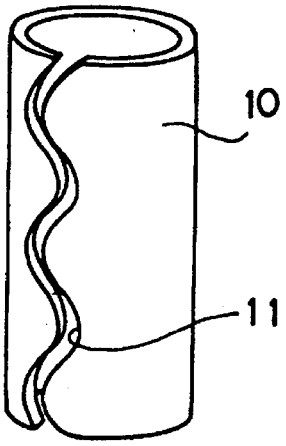
FIG. 7 is a perspective view showing a modification of the slit pipe.
Figure 8:
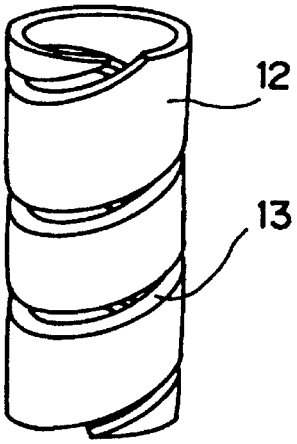
FIG. 8 is a perspective view showing another modification of the slit pipe.

FIG. 7 shows a slit pipe for resolving such a disadvantage. A slit pipe 10 has a corrugated slit 11. FIG. 8 shows a slit pipe 12 having a spiral slit 13.

In such a slit pipe, an outer diameter of the slit pipe 10 (12) at the slit 11 (13) in the entire axial direction of the slit pipe is the same as an outer diameter of the pipe where the slit is not formed. Consequently, even if the slit is positioned in any position, the slit pipe may not be removed from the groove 5*a*.

Figure 9:
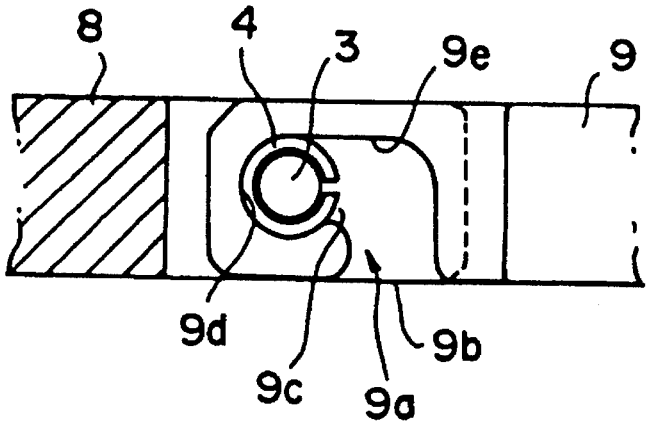
FIG. 9 is a sectional side view showing a connecting structure of a third embodiment.

Referring to FIG. 9 showing a third embodiment of the present invention for a connecting structure of the band. The slit pipe 4 is mounted on a link 8 on a rear portion, and the pin 3 is secured to the link, in the same manners as the second embodiment. A link 9 has an inverted L-shaped groove 9a downwardly opened. The groove 9a has an opening 9b, an introducing portion 9e having an inverted L-shape to be communicated with the opening 9b, a corner portion 9c, and an inner groove 9d at an innermost end of the corner portion 9c having an approximately circular shape in section. The widths of the opening 9b and the corner portion 9c are smaller than the outer diameter of the slit pipe 4, and larger than that when the slit pipe is compressed in the radial direction. The diameter of the inner groove 9d is larger than the outer diameter of the slit pipe 4.

In order to connect the links 8 and 9 of the band, the slit pipe 4 mounted on the pin 3 is engaged with the opening 9b of the groove 9a of the link 9 and pushed in the groove 9a through the opening 9b in the same manner as the previous embodiment. The slit pipe 4 is compressed in the radial direction at the opening 9b and the corner portion 9c and reaches the inner groove 9d. The slit pipe is returned to the original in the inner groove 9d. Thus, the link 8 is connected to the link 9.

In order to disengage the links 8 and 9, the slit pipe 4 of the link 8 is pulled out from the groove 9a of the link 9 with force.

In the embodiment, unless the slit pipe 4 is compressed at the opening 9b and the corner portion 9c, the engagement of the slit pipe with the groove 9a is ensured. Furthermore, unless the slit pipe 4 is moved along the inverted L-shaped groove 9a, the slit pipe is hardly removed from the groove 9a. Thus, even if considerable force is linearly exerted on the links 8 and 9, the links 8 and 9 may not be disengaged.

Figure 10:
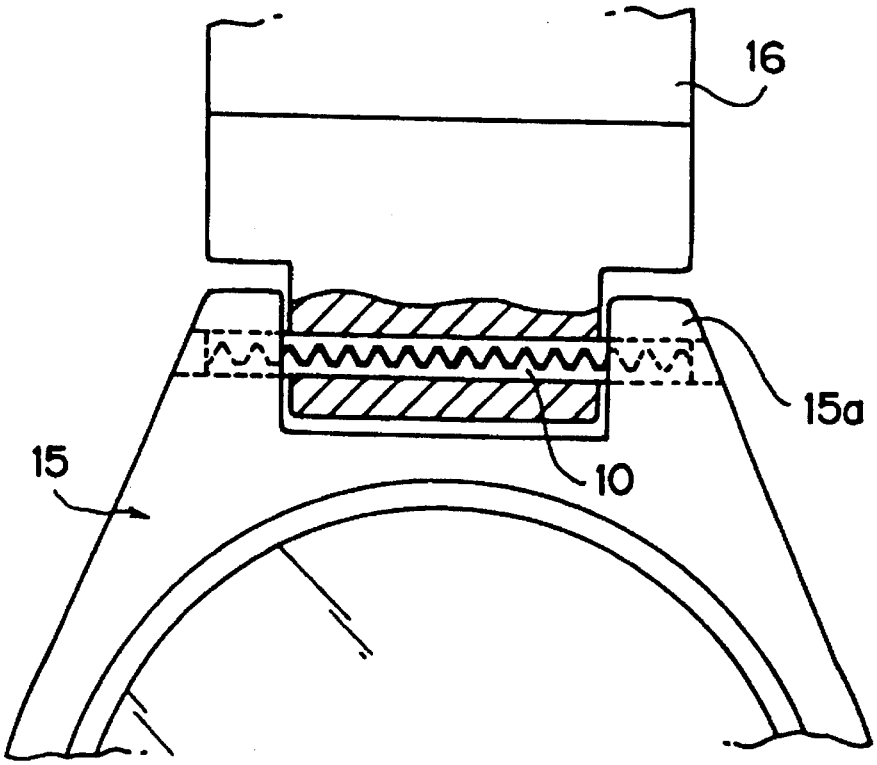
FIG. 10 is a plan view showing a connecting structure of a fourth embodiment.
Figure 11:
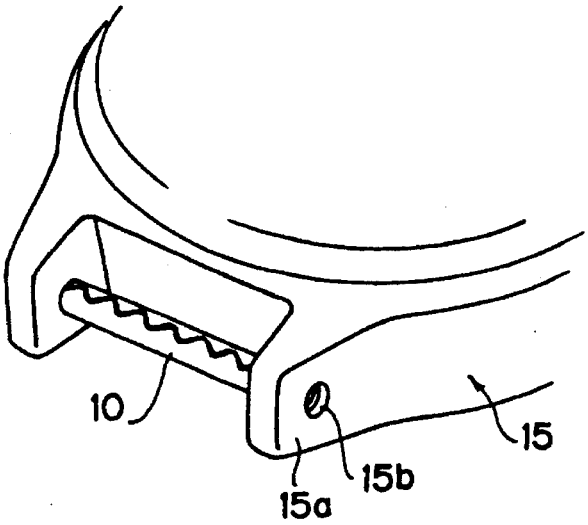
FIG. 11 is a perspective view showing a part of a watch case of FIG. 10.

FIGS. 10 and 11 show a fourth embodiment of the present invention. In the previous embodiment, the pin 3 is inserted into the slit pipe 4. In the embodiment, only a slit pipe is used for connecting watch case and band.

A watch case 15 comprises a pair of leg portions 15a each of which has a hole 15b. The slit pipe 10 is inserted into the holes 15b and opening portions of the holes are closed by brazing, thereby preventing the slit pipe 10 from removing.

Figure 12:
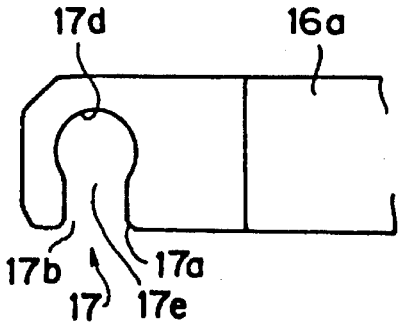
FIG. 12 is a side view showing a connecting link of a band of FIG. 10.

Referring to FIG. 12, a watch band 16 has a connecting link 16a having a groove 17 which is the same as the first embodiment. The groove 17 has a guide portion 17a, an opening 17b, an introducing portion 17e, and an inner groove 17d having an approximately circular shape in section. Similarly to the first embodiment, the diameter of the inner groove 17d is larger than the width of the opening 17b. The width of the opening 17b is smaller than the outer diameter of the slit pipe 10 and larger than that when the slit pipe is compressed in the radial direction. The diameter of the inner groove 17d is slightly larger than the outer diameter of the slit pipe 10.

In order to connect the band 16 to the case 15, the groove 17 of the connecting link 16a is engaged with the slit pipe 10 of the case 15 and pushed in the radial direction of the pipe. The slit pipe 10 is compressed passing through the opening 17b and expanded in the inner groove 17d. Thus, the band 16 is connected to the case 15.

Figure 13:
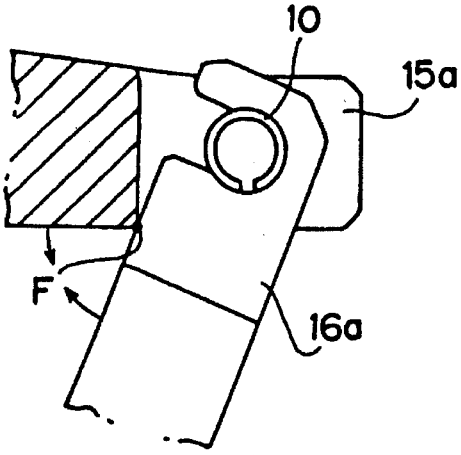
FIG. 13 is a sectional side view showing a disconnecting operation in the fourth embodiment.

In order to disengage the band 16 from the case 15, the case 15 and the connecting link 16a are positioned to form a V-shape as shown in FIG. 13. The case and the band are strongly pushed at a fulcrum F. The slit pipe 10 is easily removed from the groove 17 so that the band is disengaged from the case.

In the embodiment, since the case and the band are connected with each other only by the slit pipe, the connecting structure is simplified.

Figure 14:
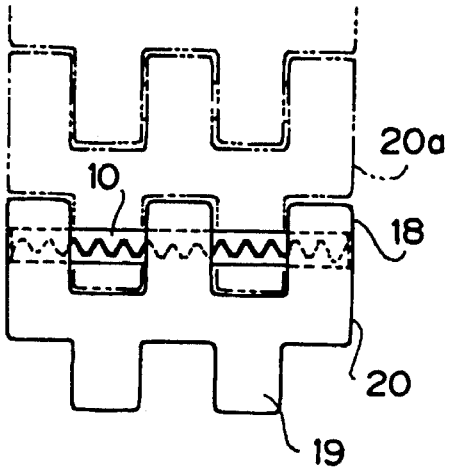
FIG. 14 is a plan view showing a connecting structure of a fifth embodiment.

FIG. 14 shows a fifth embodiment for a connecting structure of links of the band. A link 20 comprises three connecting projections 18 and a pair of connecting projections 19 provided opposite to the projections 18. The slit pipe 10 is secured to the connecting projections 18. The connecting projection 19 has the groove 17 of the FIG. 12. Thus, connecting and disconnecting operations of links 20 and 20a are operated in the same manners as the fourth embodiment.

Figure 15:
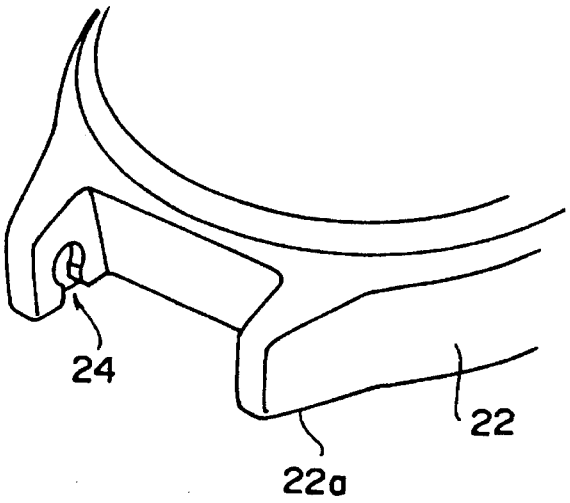
FIG. 15 is a perspective view showing a part of a watch case of a sixth embodiment.
Figure 16:
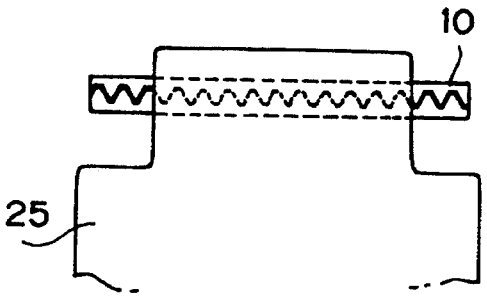
FIG. 16 is a plan view showing a connecting link of the sixth embodiment.
Figure 17:
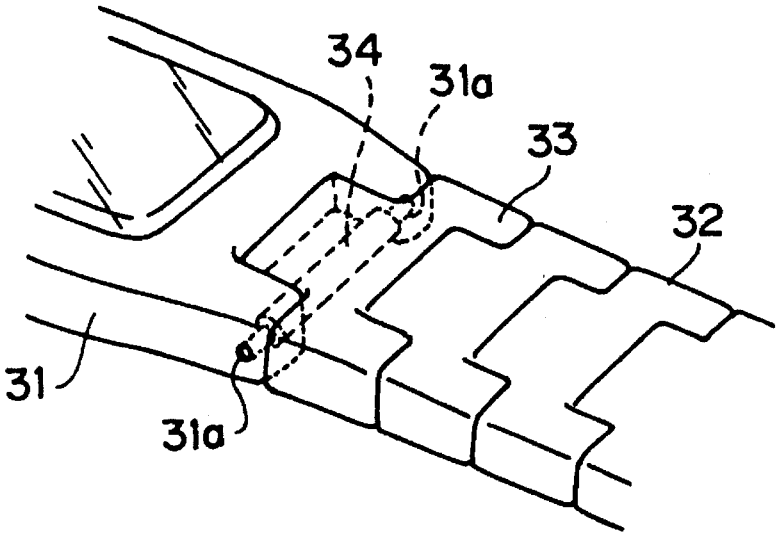
FIG. 17 PRIOR ART
FIG. 17 is a perspective view showing a conventional connecting structure of a watch case and a band.
Figure 18:
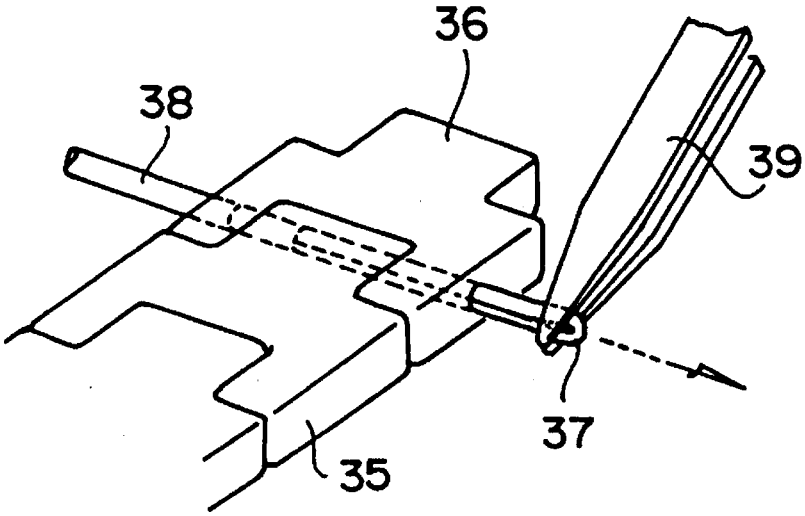
FIG. 18 PRIOR ART
FIG. 18 is a perspective view showing a conventional connecting structure of a band.

Referring to FIGS. 15 and 16 showing a sixth embodiment, a watch case 22 has a pair of leg portions 22a. A groove 24 which is the same as the groove 17 is provided in an inside wall of each of the leg portions 22a as a blind hole. Thus, a hole is not exposed on an outside of the leg portion. The slit pipe 10 is secured to a connecting link 25.

The methods for connecting and disconnecting operation of the watch case and the connecting link are the same as the fourth embodiment.

In the embodiment, the connecting structure provides a good appearance since no holes are formed on the outside walls of the leg portions 22a.

The blind hole connecting structure of the sixth embodiment can be applied to the connection between the links of the band. In the case, the blind hole is formed in the inner wall of the projections which are positioned at the outer sides of the band and the slit pipe is attached to an inner side projection.

Although the present invention is described about the embodiments applied to the wrist watch, the invention may be applied to the bracelet.

In accordance with the present invention, connecting and disconnecting operations of a watch case and a band and an adjusting operation of the length of the band are easily performed without using a tool such as a push rod and a pair of tweezers. Consequently, changing of the band and adjusting of the length of the band can be easily carried out by the user.

In the case where the connecting structure has an inverted L-shaped groove formed in the connecting link of the band, the watch case and the band, or the links of the band are prevented from accidentally disengaging.

While the invention has been described in conjunction with preferred specific embodiment thereof, it will be understood that this description is intended to illustrate and not limit the scope of the invention, which is defined by the following claims.

What is claimed is:

1. A connecting structure for connecting a member of a wrist watch to another member of the wrist watch, comprising:

a pipe which is compressible in a radial direction thereof and attached to one of the members, positioned in a lateral direction with respect to a longitudinal direction of a band of the wrist watch;

a groove formed in the other member in the lateral direction so as to be engaged with the pipe, the groove having an opening formed on the underside of the member, an introducing portion communicating with the opening, a groove portion having an approximately circular section and formed at an innermost end of the groove, each of the opening and introducing portion having a width smaller than an outer diameter of the pipe, and larger than an outer diameter of the pipe when compressed, the groove portion having an inner diameter larger than the outer diameter of the pipe, whereby the pipe may be inserted in the groove portion from the opening passing through the introducing portion.

2. The connecting structure according to claim 1 wherein the pipe is a slit pipe having a slit in an axial direction thereof.

3. The connecting structure according to claim 1 wherein the pipe is mounted on a pin secured to one of the members.

4. The connecting structure according to claim 1 wherein both the members are pivotally connected with each other by the pipe.

5. The connecting structure according to claim 1 wherein guide portions are formed on opposite edges of the opening to be outwardly inclined.

6. The connecting structure according to claim 1 wherein one of the members is a watch case and the other members is a link of the band.

7. The connecting structure according to claim 1 wherein both the members are links of the band, respectively.

8. The connecting structure according to claim 1 wherein the introducing portion has an inverted L-shape.

9. The connecting structure according to claim 2 wherein the slit is a corrugated slit.

10. The connecting structure according to claim 2 wherein the slit pipe is mounted in a U-shaped groove formed in an inside wall of said one of said members.

11. The connecting structure according to claim 3 wherein both ends of the pipe are engaged with U-shaped grooves formed in an inside wall of the member wherein the pin is secured.

12. The connecting structure according to claim 6 wherein an overhang cover is provided on the watch case above the connecting portion of the watch case and the link of the band.

* * * * *

UNITED STATES PATENT AND TRADEMARK OFFICE

CERTIFICATE OF CORRECTION

PATENT NO. : 5,557,587

DATED : September 17, 1996

INVENTOR(S) : Susumu Tosaka and Junsuke Kashikie

It is certified that error appears in the above-indentified patent and that said Letters Patent is hereby corrected as shown below:

On title page:

Add the following missing priority information on the title page at item 30 as follows:

[30] FOREIGN APPLICATION PRIORITY DATA

Dec. 27, 1993 [JP] Japan .....5-332267

Dec. 26, 1994 [JP] Japan .....6-321082

Signed and Sealed this

Seventh Day of January, 1997

*Attest:*

*Attesting Officer*

BRUCE LEHMAN

*Commissioner of Patents and Trademarks*